US008833808B2

(12) United States Patent
Watanabe

(10) Patent No.: US 8,833,808 B2
(45) Date of Patent: Sep. 16, 2014

(54) LOCK DEVICE FOR VEHICLE

(75) Inventor: Toshimune Watanabe, Fujisawa (JP)

(73) Assignee: Shiroki Corporation, Kanagawa (JP)

( * ) Notice: Subject to any disclaimer, the term of this patent is extended or adjusted under 35 U.S.C. 154(b) by 181 days.

(21) Appl. No.: 13/391,836

(22) PCT Filed: Aug. 6, 2010

(86) PCT No.: PCT/JP2010/063367

§ 371 (c)(1),
(2), (4) Date: Feb. 23, 2012

(87) PCT Pub. No.: WO2011/024627

PCT Pub. Date: Mar. 3, 2011

(65) Prior Publication Data

US 2012/0153641 A1 Jun. 21, 2012

(30) Foreign Application Priority Data

Aug. 25, 2009 (JP) ..... 2009-194550

(51) Int. Cl.

| | |
|---|---|
| ***E05C 3/06*** | (2006.01) |
| ***E05B 85/02*** | (2014.01) |
| ***E05B 83/16*** | (2014.01) |
| ***E05B 81/14*** | (2014.01) |
| *E05B 85/26* | (2014.01) |

(52) U.S. Cl.

CPC ..... *E05B 83/16* (2013.01); *E05B 85/02* (2013.01); *E05B 85/26* (2013.01); *E05B 81/14* (2013.01); *Y10S 292/23* (2013.01)

USPC ..... 292/216; 292/201; 292/DIG. 23

(58) Field of Classification Search

USPC ..... 292/98, 216, 301, DIG. 23

See application file for complete search history.

(56) References Cited

U.S. PATENT DOCUMENTS 7,111,877 B2 * 9/2006 Larsen et al. ..... 292/216
7,434,853 B2 * 10/2008 Yamamoto et al. ..... 292/216

(Continued)

FOREIGN PATENT DOCUMENTS

CN 1985059 A 6/2007
EP 2067917 A2 6/2009

(Continued)

OTHER PUBLICATIONS

International Search Report, dated Nov. 16, 2010, issued in corresponding PCT/JP2010/063367.
Official Action dated Nov. 1, 2013, related to corresponding Chinese Patent Application No. 201080037524.8.
Written Opinion from PCT/JP2010/063367 dated Nov. 16, 2010.

(Continued)

*Primary Examiner* — Kristina Fulton
*Assistant Examiner* — Christine M Mills
(74) *Attorney, Agent, or Firm* — Millen, White, Zelano, Branigan, P.C.

(57) ABSTRACT

It is an object to obtain a lock device for vehicle which ensures smooth rotation of a lock release lever by preventing the lock release lever from coming in contact with a cam member in a direction substantially parallel to the rotation axis of the lock release lever.

The solution therefor is to provide one of a portion of a straddle portion 118 of a lock release lever 115 which is positioned beyond a cam member 104 and a support member 81 with a holding portion 95 which holds a cam follower 119 and a portion of a cam member other than a cam surface 110 thereof in a state of being spaced from each other in a direction parallel to a rotational support shaft 92 by being in slidable contact with the other.

9 Claims, 7 Drawing Sheets

(56) References Cited

U.S. PATENT DOCUMENTS

| | | | |
|---|---|---|---|
| 8,128,135 | B2 | 3/2012 | Maeta et al. |
| 2007/0220934 | A1 | 9/2007 | Chevalier |
| 2009/0145183 | A1 | 6/2009 | Maeta et al. |

FOREIGN PATENT DOCUMENTS

| | | | |
|---|---|---|---|
| JP | 2003-184393 | A | 7/2003 |
| JP | 2004-250879 | A | 9/2004 |
| WO | 2006003356 | A1 | 1/2006 |

OTHER PUBLICATIONS

* cited by examiner

LOCK DEVICE FOR VEHICLE

TECHNICAL FIELD

The present invention relates to a lock device for a vehicle which is capable of being switched from a locked state to an unlocked state by the power of an actuator.

BACKGROUND ART

Conventional technology in which a striker is projected from a vehicle body, at aback opening thereof, and a lock device which is engaged with and disengaged from the above-mentioned striker is installed to a rear door for opening and closing the back opening is disclosed in, e.g., Patent Literature 1.

This lock device includes a hook (latch) which is rotatable between an unlocked position to be disengaged from a striker and a locked position to be engaged with the striker and which is biased to rotate toward the unlocked position; a pawl (ratchet) rotatable between an engaging position to be engaged with the hook positioned in the locked position and a non-engaging position to be disengaged from the hook; a motor which rotates a worm by electric power; a worm wheel (cam member) which is in mesh with the worm and has a cam surface provided around the rotation axis thereof; and a lock release lever (output lever) which has a cam follower which comes in contact with the cam surface of the worm wheel in a direction substantially orthogonal to the rotation axis of the worm wheel, and has a press portion (output portion) which presses the pawl, wherein a portion of the lock release lever (the portion on which the cam follower is formed and a peripheral part thereof) faces the worm with a slight gap created between the lock release lever and the worm in a direction parallel to the above-mentioned rotation axis.

When the rear door is in the fully-closed position so as to close the above-mentioned back opening, the hook is in the locked position while engaged with the striker, and the pawl is in the engaging position to hold the hook in the locked position, so that the rear door is held in the fully-closed position by the lock device and the striker.

In this state, for instance, upon a lock release switch provided inside the vehicle being pressed, the motor is supplied with power and rotates. Thereupon, the worm wheel which receives a rotational force from the worm rotates, and the lock release lever which receives a force from the cam surface via the cam follower rotates, so that the press portion of the lock release lever engages with the pawl and rotates the pawl to the non-engaging position. Thereupon, the hook that is biased to rotate by a biasing device rotates to the unlocked position to release the striker, which brings the rear door into a state that is capable of opening the above-mentioned back opening.

CITATION LIST

Patent Literature

Patent Literature 1: Japanese Unexamined Patent Publication 2006-207192

SUMMARY OF THE INVENTION

Technical Problem

To achieve a smooth lock release operation in the lock device that has the above-mentioned structure, the lock release lever which receives a force from the cam surface of the worm wheel is required to rotate smoothly when the motor rotates.

However, since the distance between mutually opposed surfaces of the above-mentioned portion (the portion on which the cam follower is formed and a peripheral part thereof) of the lock release lever and the worm is narrow, there is a chance that the above-mentioned portion of the lock release lever comes in contact with the worm during rotation of the rock release lever, therefore the rotational operation of the rock release lever becomes unsmooth.

The present invention provides a lock device for a vehicle which ensures smooth rotation of the lock release lever by preventing the lock release lever from coming in contact with the cam member in a direction substantially parallel to the rotation axis of the lock release lever.

Solution to Problem

The prevent invention is characterized by including a lock device for vehicle which is installed to one of a vehicle body and a door capable of being opened and closed with respect to the vehicle body, the lock device comprising a hook rotatable between a locked position at which the hook is engaged with a striker that is provided on the other of the vehicle body and the door to hold a closed state of the door, and an unlocked position at which the hook is disengaged from the striker, the hook being biased to rotate toward the unlocked position; a pawl rotatable between an engaging position at which the pawl is engaged with the hook to hold the hook in the locked position and a non-engaging position at which the pawl is not engaged with the hook, the pawl being biased to rotate toward the engaging position; a cam member rotatable relative to a support member about a rotational center shaft and having a cam surface; an actuator which produces a driving force for rotating the cam member; and a lock release lever which includes a press portion that engages with said pawl, a cam follower which comes in contact with the cam surface in a direction substantially orthogonal to the rotational center shaft, and a rotational support shaft that is positioned between the press portion and the cam follower, is substantially parallel with the rotational center shaft, and is rotatably supported on the support member, wherein, by receiving a force from the cam surface of the cam member via the cam follower that is rotated by the actuator, the lock release lever rotates from a lock allowable position at which the pawl is allowed to be positioned in the engaging position until a lock release position at which the press portion rotates the pawl to the non-engaging position; wherein a portion that is closer to the cam follower side than the rotational support shaft of the lock release lever constitutes a straddle portion which extends over the cam member while facing the cam member in a direction parallel to the rotational support shaft, and wherein a holding portion is formed on one of a portion of the straddle portion that extends over the cam member and the support member to be in slidable contact with the other, to thereby hold the cam follower and a portion of the cam member other than the cam surface in a separated state in a direction that is parallel to the rotational support shaft.

The straddle portion of the lock release lever can be substantially straight in shape.

It is acceptable for a pressed portion to be formed at the end of the lock release lever to enable a locked state to be released by pressing the pressed portion.

Advantageous Effects of the Invention

Since the lock device of the present invention is equipped with the holding portion, the lock release lever is held in a state where the cam follower is spaced from the cam member in a direction parallel to the rotational support shaft of the lock release lever. Therefore, during rotation of the lock release lever, the cam follower does not come in contact with the cam member in a direction parallel to the rotational support shaft. Consequently, smooth rotation of the lock release lever is ensured, so that the lock release operation of the lock device of the present invention is performed smoothly at all times.

Additionally, since the lock release lever is supported in a double-end supporting manner with respect to the support member by the rotational center portion and the holding portion that are respectively positioned at both ends of the lock release lever with the cam follower positioned therebetween, the state of supporting the lock release lever is stabilized. Therefore, the lock release lever rotates smoothly even if an unexpected external force is exerted on the lock release lever.

DESCRIPTION OF EMBODIMENTS

Figure 1:
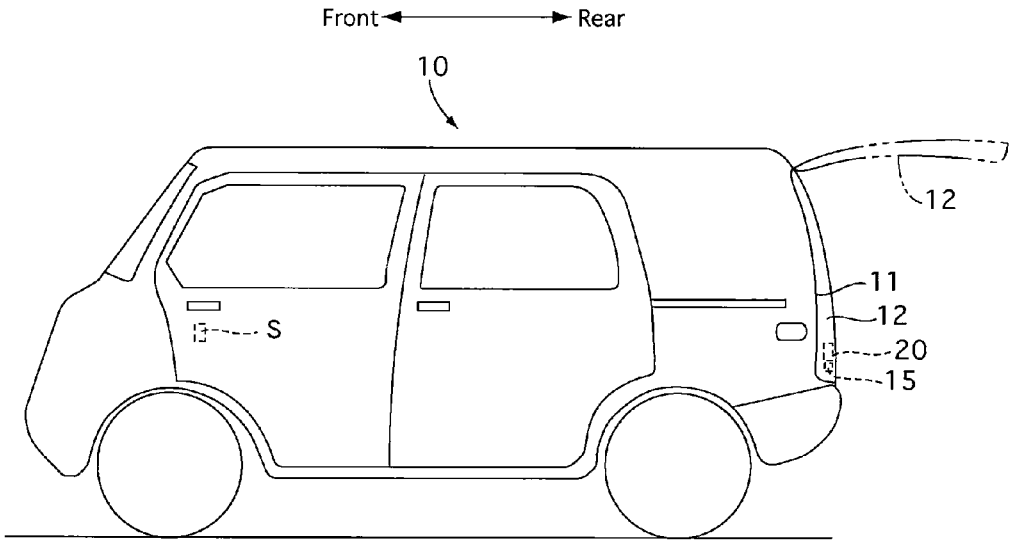
FIG. 1 is a side view of a vehicle to which an embodiment of the present invention has been applied.

An embodiment of the present invention will be hereinafter discussed with reference to the accompanying drawings. Directions described in the following description are defined based on the directions of arrows shown in the drawings.

A back opening 11 is formed in the back of a vehicle body of an automobile 10, and a back door 12 having the same shape as the back opening 11 is mounted to the upper edge of the back opening 11 to be rotatable about a rotational axis extending in the leftward/rightward direction. The back door 12 is rotatable between a fully-closed position (the position of the solid lines in FIG. 1) to fully close the back opening 11 and a fully-open position (the position of the imaginary lines in FIG. 1) to be positioned substantially horizontal to fully open the back opening 11. As shown in FIG. 1, a metal striker 15 projects upward from the base of the back opening 11. In addition, a lock device 20 disengageably engageable with the striker 15 is installed to a portion which constitutes a lower surface of the back door 12 when the back door 12 is in the fully-closed position.

Next the structure of the lock device 20 will be discussed in detail hereinafter. The upward/downward direction and the forward/rearward direction when the lock device 20 is illustrated are defined to correspond to directions when the back door 12 is in the fully-closed position.

As shown in FIGS. 2 through 8, the lock device 20 is provided with a lock unit 25 and an actuator unit 80.

The lock unit 25 is a unit which extends substantially in the horizontal direction when the back door 12 is in the fully-closed position. A metal support case 26 is provided with an accommodation recess 27 which is recessed in a center of the support case 26, and a left and right pair of fixing lugs 28 for the fixation of the back door 12. The rear portion of the accommodation recess 27 is open, and a striker entry groove 29 which extends rearward from the front end thereof is formed at the base of the accommodation recess 27. In addition, a curved elongated protrusion 32 having a curved profile protrudes from a base surface of the accommodation recess 27.

Figure 3:
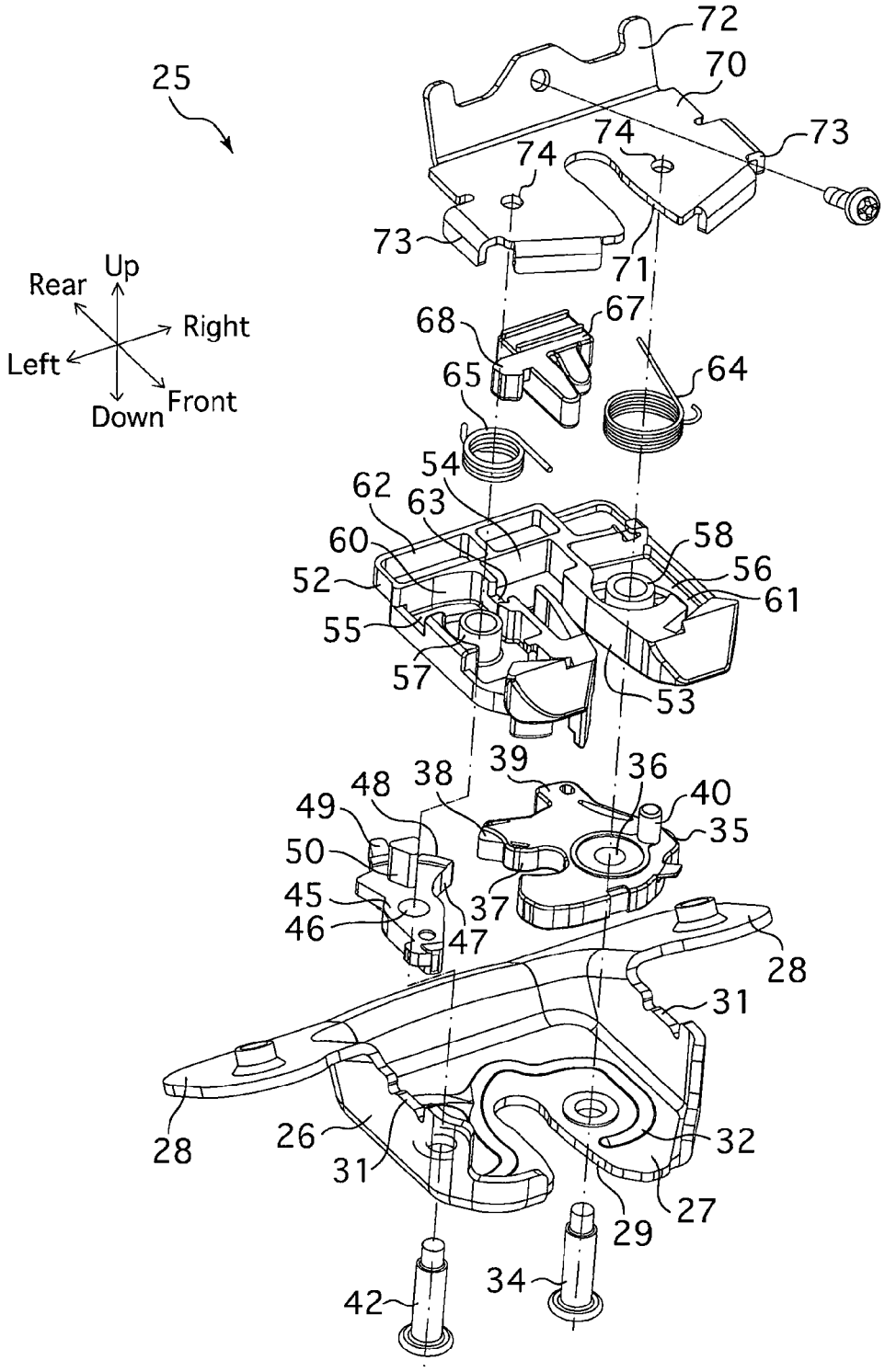
FIG. 3 is an exploded perspective view of a lock unit.
Figure 4:
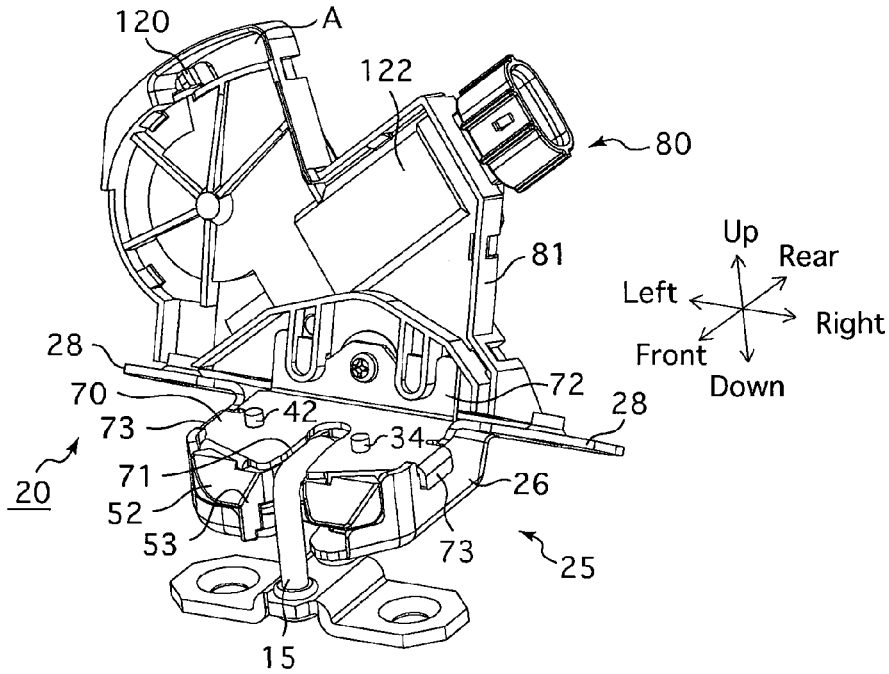
FIG. 4 is a front perspective view of a lock device, viewed obliquely from above.
Figure 5:
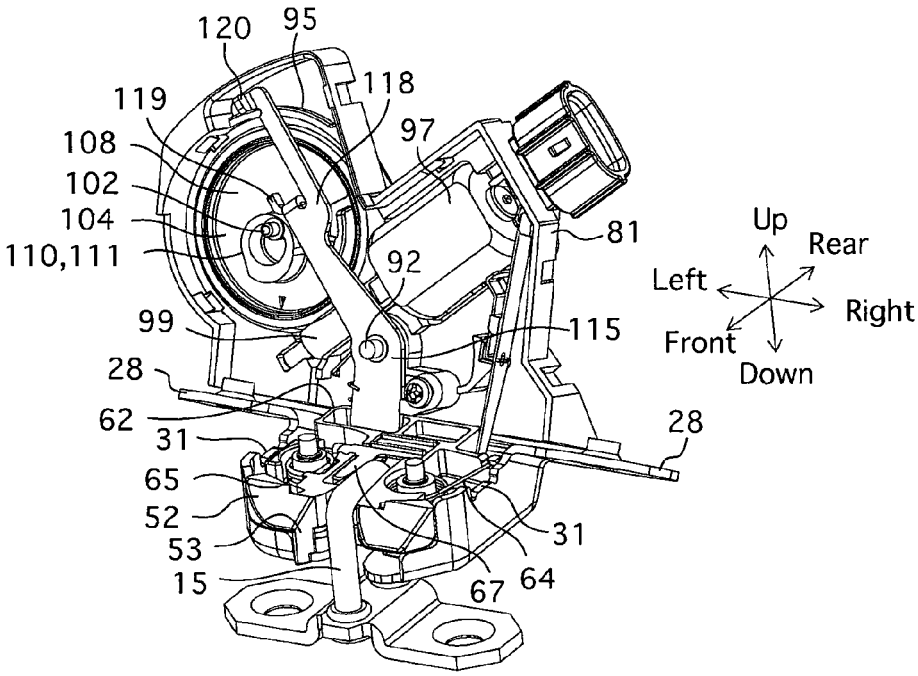
FIG. 5 is a front perspective view of the lock device viewed obliquely from above with a top cover and a front cover removed.

Positioning recesses 31 are formed in upper edges of the side walls positioned on both the left and right sides of the accommodation recess 27, respectively. As shown in FIGS. 3 and 5, recesses which are semicircular in shape in side view are formed at both the front and rear ends of the lower edge of each positioning recess 31 to be recessed down to a position below the center of the lower edge thereof. Since it is not easy to machine both the front and rear ends of the lower edge of each positioning recess 31 precisely into square corners, there is a possibility of the width of the lower part of each positioning recess 31 in the forward/rearward direction becoming narrower than the width of the upper part of the same in the forward/rearward direction if both the front and rear ends of the lower edge of each positioning recess 31 are machined into square corners. However, if such recesses are formed, the widths of the positioning recesses 31 in the forward/rearward direction can be reliably made mutually identical at all the vertical positions.

A hook support shaft 34 and a pawl support shaft 42 are inserted into two circular through-holes from below which are formed in the base of the accommodation recess 27.

A circular support hole 36 which is formed through the center of a hook 35 is rotatably engaged with a portion of the hook support shaft 34 which is positioned inside the accommodation recess 27, and the lower surface of hook 35 is in contact with the curved elongated protrusion 32. A lock groove 37 is recessed in a peripheral surface of the hook 35, and a lock projection 38 and a half-lock projection 39 are projected from a peripheral surface of the hook 35. In addition, a spring hook projection 40 is projected from an upper surface of the hook 35. The hook 35 is rotatable about the hook support shaft 34 between an unlocked position shown in FIG. 6 and a locked position shown in FIG. 8.

Figure 9:
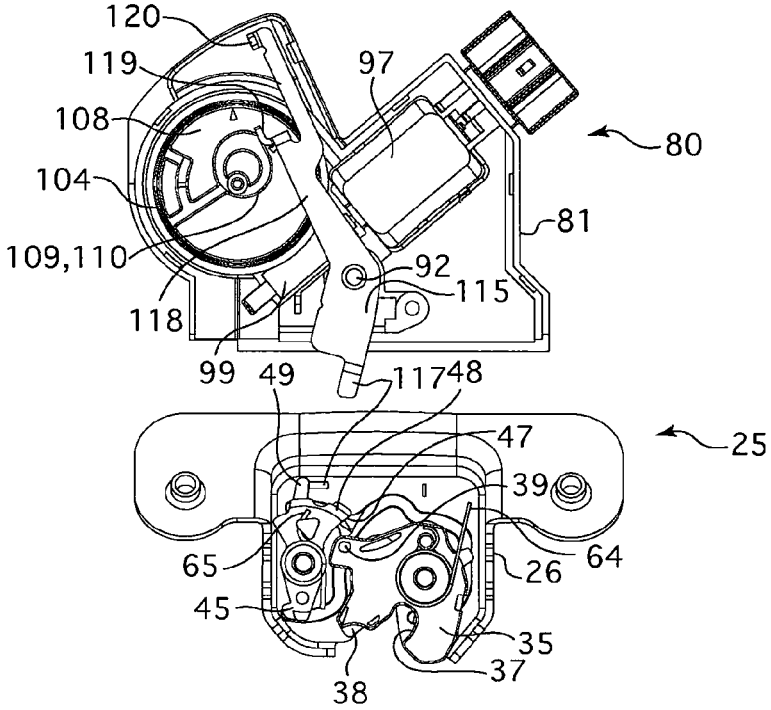
FIG. 9 is a view similar to that of FIG. 6 when the lock device is brought into an unlocked state by using the lock release lever.

A circular support hole 46 formed through the center of a pawl 45 is rotatably engaged with the pawl support shaft 42, and the lower surface of the pawl 45 is in contact with the curved elongated protrusion 32. An unlocking engaging surface 47 is formed on a portion of the peripheral surface of the pawl 45 which faces the hook 35. In addition, an engaging projection 48 and a pressed portion 49 are projected from a rear surface of the pawl 45. Additionally, a pressed projection 50 having a triangular prism shape is projected upward from an upper surface of the pawl 45. The pawl 45 is rotatable between an engaging position shown in FIGS. 6 and 7 and a non-engaging position shown in FIG. 9.

The hook 35 and the pawl 45 are positioned in a lower half of the accommodation recess 27, and a spring support member 52 made of synthetic resin which has substantially in the same planar shape as the accommodation recess 27 is accommodated in an upper half of the accommodation recess 27.

A striker entry groove 53 which extends rearward is formed at the front edge of the spring support member 52, and an engagement holding groove 54 which is communicatively connected to the rear of the striker entry groove 53 is formed at a center of the spring support member 52 as a through-hole which extends through the spring support member 52 in the vertical direction. A left and right pair of spring accommodation spaces 55 and 56 which are partitioned from the striker entry groove 53 and the engagement holding groove 54 by walls are formed in the spring support member 52. A rotational support cylinder 57 having a cylindrical shape which is open at both upper and lower ends thereof is provided on the base of the spring accommodation space 55, and a rotational support cylinder 58 having a cylindrical shape which is open at both upper and lower ends thereof is provided on the base of the spring accommodation space 56. A circular-arc groove 60 centered around the rotational support cylinder 57 is formed as a through-hole on the base of the spring accommodation space 55, and a circular-arc groove 61 centered around the rotational support cylinder 58 is formed as a through-hole on the base of the spring accommodation space 56. Additionally, an insertion hole 62 which extends through the spring support member 52 in the vertical direction is formed through the rear end of the spring support member 52, and a notch 63 is formed at the upper end of the wall which partitions between the engagement holding groove 54 and the spring accommodation space 55.

Accommodating the spring support member 52 in the upper half of the accommodation recess 27 causes the spring support member 52 to become impossible to rotate with respect to the accommodation recess 27 (about a vertical axis), causes the lower surface of the spring support member 52 to come in contact with upper surfaces of the hook 35 and the pawl 45, and further causes the tops of the hook support shaft 34 and the pawl support shaft 42 to be inserted into the rotational support cylinder 58 and the rotational support cylinder 57, respectively, and causes the spring hook projection 40 and the pressed projection 50 to be relatively rotatably inserted into the circular-arc groove 61 and the circular-arc groove 60, respectively.

A torsion coil spring 64 is accommodated in the spring accommodation space 56, and the coiled portion of the torsion coil spring 64 is positioned around the rotational support cylinder 58. On the other hand, a torsion coil spring 65 is accommodated in the spring accommodation space 55, and the coiled portion of the torsion coil spring 65 is positioned around the rotational support cylinder 57. One end of the torsion coil spring 64 is hooked onto the spring support member 52 and the other end of the torsion coil spring 64 is hooked onto the spring hook projection 40, so that the hook 35 is continuously biased to rotate toward the unlocked position by the biasing force of the torsion coil spring 64. On the other hand, one end of the torsion coil spring 65 is hooked onto the spring support member 52 and the other end of the torsion coil spring 65 is hooked onto the pressed projection 50 of the pawl 45, so that the pawl 45 is continuously biased to rotate toward the engaging position by the biasing force of the torsion coil spring 65.

In addition, a retaining member 67 made of hard rubber is engaged in the engagement holding groove 54 of the spring support member 52 so as to be prevented from rotating. A retaining projection 68 which projects from the left side of the retaining member 67 is positioned inside the spring accommodation space 55 through the notch 63, and the undersurface of the retaining projection 68 is in contact with the upper end surface of the pressed projection 50.

A top cover 70 that is formed out of a press-formed metal plate is placed on top of the support case 26. A striker entry groove 71 which extends rearward is recessed into the front edge of the top cover 70. In addition, an oblique connecting lug 72 is formed at the rear of the top cover 70, and engaging lugs 73 having the shape of a substantially letter L in cross section which are engaged with the left and right positioning recesses 31 are projected from both the left and right sides of the top cover 70, respectively. In addition, a left and right pair of support holes 74 are formed as through-holes on both sides of the striker entry groove 71, respectively.

The engaging lugs 73 are substantially the same in width in the forward/rearward direction as the positioning recesses 31. Additionally, since the widths of the positioning recesses 31 in the forward/rearward direction are made to be mutually identical at all the vertical positions by forming the above-mentioned semicircular recesses at both the front and rear ends of the lower edge of each positioning recess 31, the left and right engaging lugs 73 can be smoothly engaged in the left and right positioning recesses 31; moreover, when the engaging lugs 73 are engaged in the positioning recesses 31, both the front and rear surfaces of the engaging lugs 73 come in surface contact securely with the front and rear surfaces of the positioning recesses 31, respectively. Therefore, placing the top cover 70 onto the support case 26 causes the top cover 70 to become immovable in both the forward/rearward direction and the leftward/rightward direction with respect to the support case 26. In addition, placing the top cover 70 onto the support case 26 causes the upper ends of the hook support shaft 34 and the pawl support shaft 42 to be engaged in the corresponding support holes 74 and causes the lower surface of the top cover 70 to come in contact with an upper surface of the retaining member 67. Additionally, the oblique connecting lug 72 is positioned in front of the insertion hole 62 in plan view, the insertion hole 62 is exposed upwardly even when the top cover 70 is placed onto the support case 26. Additionally, the upper ends of the hook support shaft 34 and the pawl support shaft 42 are swaged against the margins of the support holes 74, and accordingly, the top cover 70 does not come off the support case 26.

The actuator unit 80 is a unit which lies substantially orthogonal to the lock unit 25, and which extends substantially in the vertical direction when the back door 12 is in the fully-closed position.

An accommodation recess 82 which is open at the front and bottom thereof is formed in a rear casing (support member) 81 of the actuator unit 80. In addition, a motor accommodation space 83 that is substantially in the shape of a rectangle in a front view and a worm-wheel accommodation space 84 substantially in the shape of a circle in a front view which are partitioned by walls provided on outer edges of the rear casing 81, walls provided inside the accommodation recess 82, etc., are formed in the accommodation recess 82, and a partition wall 85, which partitions the motor accommodation space 83 from the worm-wheel accommodation space 84 and has a shaft support recess 86, is projected between the motor accommodation space 83 and the worm-wheel accommodation space 84. A circular support seat 88 is projected forward from a base surface (rear surface) of the worm-wheel accommodation space 84. A rotational support cylinder 89 having a cylindrical shape which is open at the front thereof and a spring-support elongated protrusion 90 having a circular arc shape centered about the rotational support cylinder 89 are projected from the support seat 88. Additionally, a rotational support shaft 92, a female screw hole 93 and a support recess 94 are formed on the base surface of the accommodation recess 82.

Additionally, a holding elongated protrusion (holding portion) 95 having a circular arc shape with the rotational support cylinder 89 as an approximate center is projected from an upper part of the base surface of the accommodation recess 82.

A motor (actuator) 97 is fitted (accommodated) into the motor accommodation space 83. An output shaft 98 which rotates about the axis thereof is provided to linearly extend toward the downward and leftward side of the motor 97 from an end surface of the motor 97 on the downward and leftward side thereof. The output shaft 98 is positioned inside the worm-wheel accommodation space 84 through the shaft support recess 86 of the partition wall 85, and the end of the output shaft 98 is rotatably supported by the support recess 94. A worm 99 parallel to the output shaft 98 is formed integral with the periphery of a portion of the output shaft 98 which is positioned inside the worm-wheel accommodation space 84. The motor 97 is connected to a power source not shown in the drawings, and pressing a lock release switch S (see FIG. 1) provided on an operation panel inside the automobile 10 causes the motor 97 to be supplied with power from the power source to rotate forward by a predetermined angle of rotation, thus causing the output shaft 98 and the worm 99 to rotate forward in one direction at a predetermined angle of rotation.

A coil spring 100 is mounted on the support seat 88, which is formed in the worm-wheel accommodation space 84, in a manner so as to be positioned around the spring-support elongated protrusion 90. One end of the coil spring 100 is hooked onto an engaging projection (not shown) formed on the support seat 88.

Figure 2:
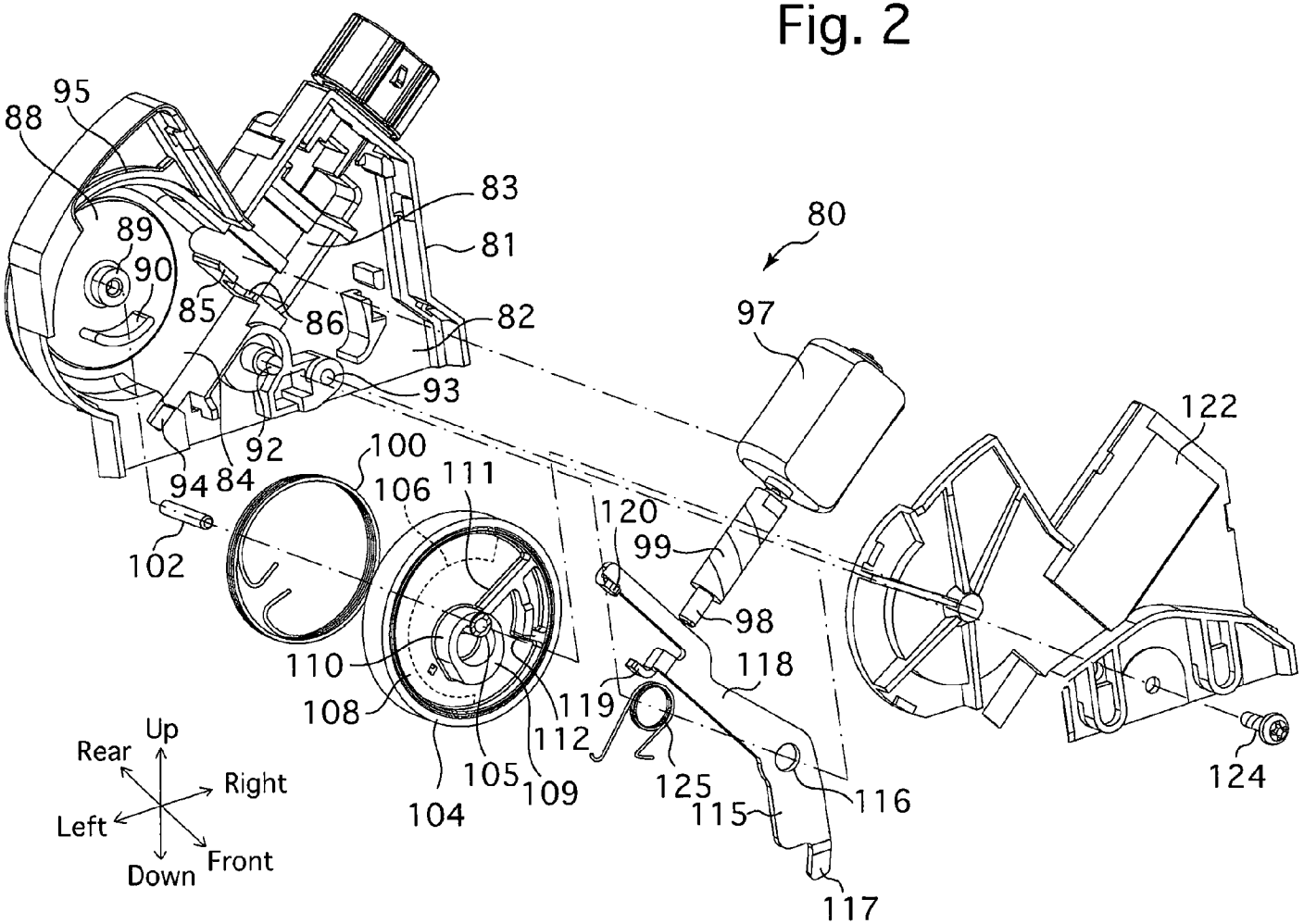
FIG. 2 is an exploded perspective view of an actuator unit.

The rear end of a rotational center shaft 102 which extends substantially parallel to the rotational support shaft 92 is fixedly fitted into the rotational support cylinder 89, and the front part of the rotational center shaft 102 is fitted into a support through-hole 105 formed through the center of a worm wheel (cam member) 104, made of synthetic resin, to allow the worm wheel 104 to rotate relative to the rotational center shaft 102. The worm wheel 104 is provided, at the inner peripheral surface of the circular edge of the rear surface of the worm wheel 104, with a recessed portion for receiving the coil spring 100 (see FIG. 10), and a circular-arc-shaped projection 106 which is in the shape of a substantially circular arc and comes in contact with the coil spring 100 to be capable of rotating relative to the coil spring 100 is projected from a base surface (rear surface) of the above-mentioned recessed portion (see FIGS. 2 and 10). In addition, the other end of the coil spring 100 is hooked onto an engaging projection formed in the above-mentioned recessed portion of the worm wheel 104. As shown in FIG. 2 and other drawings, etc., a rearward recess 108 having a substantially circular shape is formed on the front of the worm wheel 104. A cam portion 109 which is positioned around the support through-hole 105 is provided so as to projected from a bottom surface (front surface) of the rear rearward recess 108, and the peripherialy surface of the cam portion 109 is formed as a cam surface 110, the radial distance from the support through-hole 105 to the cam surface 110 varying depending on the circumferential position thereat. In addition, a first stopper 111 and a second stopper 112 which are for restricting the rotational range of a cam follower 119, discussed later, inside the rearward recess 108 are projected from the base of the rearward recess 108.

Upon the worm wheel 104 being installed in the worm-wheel accommodation space 84 via the rotational center shaft 102, teeth (not shown) formed on the periphery of the worm wheel 104 are engaged with the worm 99. The worm wheel 104 is held in an initial position shown in FIGS. 6 through 8 by the rotational biasing force of the coil spring 100 when receiving no rotational force from the worm 99; however, upon the worm 99 rotating in the above-mentioned one direction upon the lock release switch S being depressed, the worm wheel 104 rotates to an operating position shown in FIG. 9 against the biasing force of the coil spring 100.

A rotational support hole 116 which is formed in a lock release lever 115, formed as a metal thin bar member, is fitted onto the rotational support shaft 92 of the rear casing 81. The lock release lever 115 is supported by the rotational support shaft 92, thereby being capable of rotating relative to the rear casing 81 in a plane orthogonal to the axis of the rotational support shaft 92. A press portion 117 is projected from the lower end of the lock release lever 115. A portion of the lock release lever 115 above the rotational support hole 116 constitutes, as a whole, a straddle portion 118 having a substantially linear shape, and a cam follower 119 is provided so as to project from a middle part of the straddle portion 118. Additionally, a pressed projection 120 is projected forward from the end (upper end) of the straddle portion 118.

Upon the lock release lever 115 being installed to the rear casing 81 by fitting the rotational support hole 116 onto the rotational support shaft 92, the cam follower 119 is positioned inside the rearward recess 108 of the worm wheel 104 as shown in FIGS. 5 through 10. Furthermore, the straddle portion 118 is positioned immediately in front of the worm wheel 104 (to face the worm wheel 104 in the forward/rearward direction) and extends over the upper portion of the worm wheel 104. A portion of the rear surface of the straddle portion 118 in the vicinity of the end thereof is supported by the front surface of the holding elongated protrusion 95 to be slidable thereon (see FIG. 10).

A front cover 122 which has substantially the same front shape as the rear casing 81 is placed on the front of the rear casing 81, and the front cover 122 is fixed to the rear casing 81 by a set screw 124 which passes through the lower end of the front cover 122 to be screw-engaged with the female screw hole 93. As shown in the drawings, the coiled portion of a torsion coil spring 125 positioned between the lock release lever 115 and the front cover 122 is installed onto the front of the rotational support shaft 92. One end of the torsion coil spring 125 is hooked onto the lock release lever 115 and the other end of the same is hooked onto a catching projection (not shown) formed on a rear surface of the front cover 122. In this manner the lock release lever 115 receives a counter-clockwise rotational biasing force from the torsion coil spring 125 with respect to FIGS. 6 through 9, and accordingly, the cam follower 119 is in contact with the cam surface 110 of the cam portion 109 at all times (in a direction substantially orthogonal to the rotational center shaft 102). Therefore, when the worm wheel 104 remains in the initial position without the lock release switch S depressed, the lock release lever 115 is in a lock allowable position shown in FIGS. 6 through 8, and depressing the lock release switch (rotating the motor 97 forward) causes the worm wheel 104 to rotate to the operating position; thereupon, the cam follower 119 receives a rotational force from the cam surface 110, which causes the lock release lever 115 to rotate to the lock release position shown in FIG. 9 against the rotational biasing force of the torsion coil spring 125. When the lock release lever 115 moves to the lock release position, the power supply to the motor 97 from the above-mentioned power source is shut off, so that the motor 97 stops. Thereupon, the lock release lever 115 rotates back to the lock allowable position by the biasing force of the torsion coil spring 125, while the worm wheel 104 returns to the above-mentioned initial position by the rotational biasing force of the coil spring 100, so that the output shaft 98 (and the motor 97) rotates reverse to the initial position.

The lock unit 25 and the actuator unit 80 that have the above described structure are connected to each other in a mutually immovable state by securing the oblique connecting lug 72 to the front cover 122 with a set screw with the lower end of the actuator unit 80 positioned behind the oblique connecting lug 72 of the lock unit 25.

When the lock device 20 is constructed by connecting the lock unit 25 and the actuator 80 to each other, the press portion 117 of the lock release lever 115 passes through the through-hole 62 of the spring support member 52 to enter the accommodation recess 27, thus being positioned on the right-hand side of the pressed portion 49 of the pawl 45 as shown in FIGS. 6 through 9.

Operations of the lock device 20 that has the above described structure will be discussed hereinafter.

Figure 6:
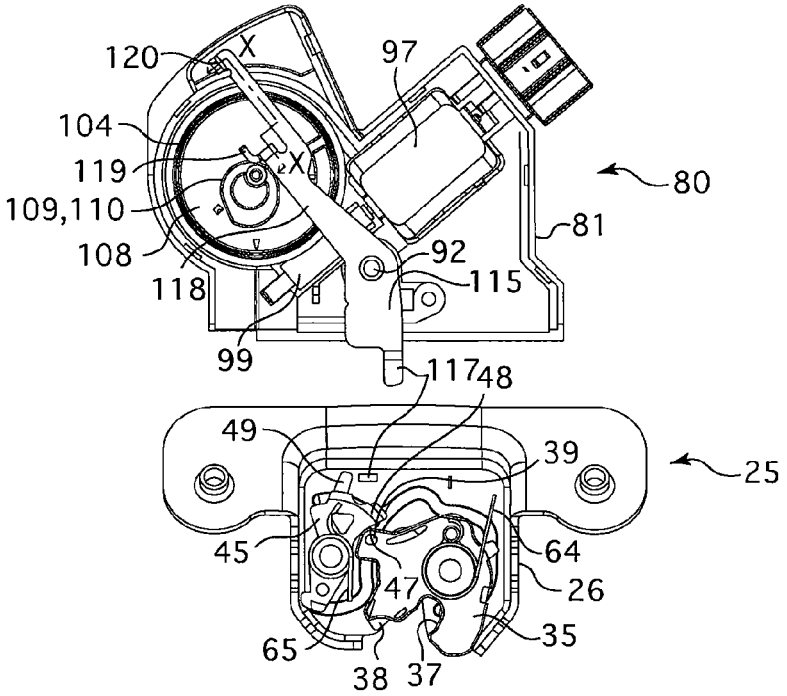
FIG. 6 is a view showing the actuator unit and the lock unit under unlocked condition which are mutually separated and laid on a plane with the top cover and the front cover removed.

When the back door 12 is in an open state as shown by imaginary lines in FIG. 1, the lock device 20 is in the unlocked state shown in FIG. 6. In other words, the striker 15 is positioned outside the striker entry groove 29 of the support case 26 (the striker 15 is not shown in FIG. 6), the hook 35 is in the unlocked position by the biasing force of the torsion coil spring 64, and the pawl 45 is biased to rotate toward the engaging position by the torsion coil spring 65, so that the unlocking engaging surface 47 is engaged with the half-lock projection 39 of the hook 35.

Figure 7:
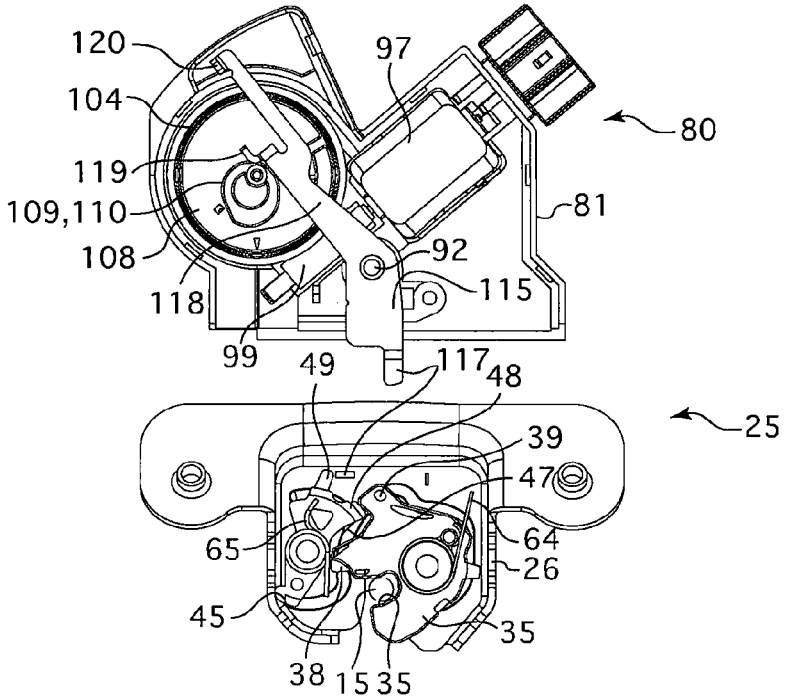
FIG. 7 is a view similar to that of FIG. 6 showing a half-locked state.
Figure 8:
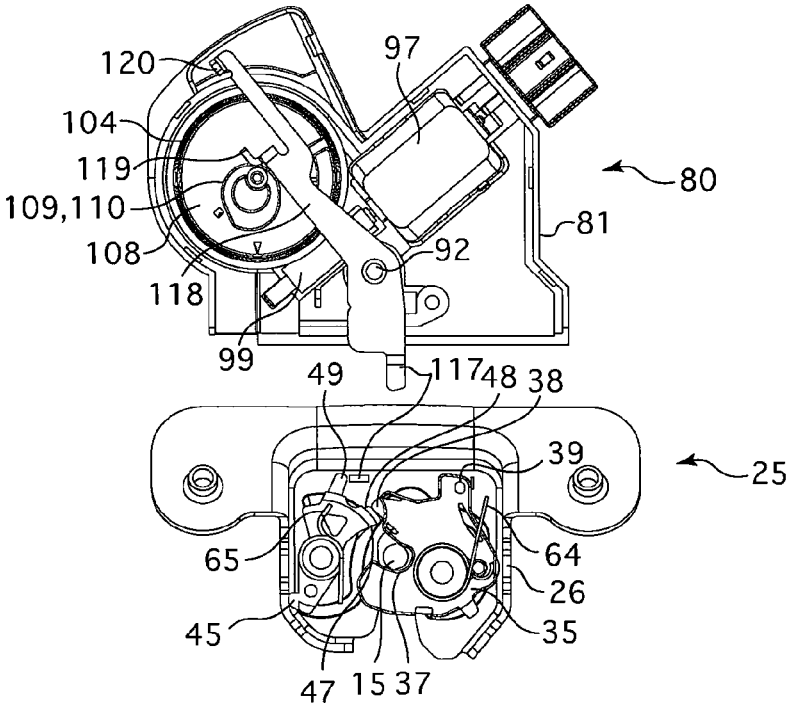
FIG. 8 is a view similar to that of FIG. 6 showing a locked condition.

From this state, if the backdoor 12 is closed to thereby cause the striker 15 to enter the striker entry groove 29 (and the striker entry grooves 53 and 71), the hook 35 rotates in the clockwise direction with respect to FIG. 6 against the biasing force of the torsion coil spring 64. Thereupon, as shown in FIG. 7, the striker 15 enters the inside of the striker entry groove 29 (and the striker entry grooves 53 and 71) and the hook 35 rotates to the half-locked position shown in FIG. 7. At this stage, the half-lock projection 39 of the hook 35 comes in contact with the engaging projection 48 of the pawl 45 as shown in FIG. 7, and accordingly, in this state if the closing operation of the back door is stopped, the hook 35 is held in the half-locked position.

From this half-locked state, closing the back door 12 to the fully-closed position causes the striker 15 to further enter the striker entry groove 29 (and the striker entry grooves 53 and 71) toward the inner side and causes the hook 35 to rotate to the locked position. In addition, the lock projection 38 of the hook 35 is engaged with the engaging projection 48 of the pawl 45 to thereby prevent the hook 35 from rotating in the counterclockwise direction, so that the striker 15 is locked by the lock groove 37 of the hook 35 (the striker 15 becomes incapable of moving out of the striker entry grooves 29, 53 and 71 of the hook 35).

To release such a locked state, it is required to press the lock release switch S. Consequently, the above-mentioned power source passes current through the motor 97 to rotate the motor 97 forward, thus rotating the worm 99 forward by the power of the motor 97. This causes a rotational force to be transmitted from the worm 99 to the worm wheel 104, so that the worm wheel 104 which is positioned at the initial position rotates in the counterclockwise direction with respect to FIG. 8 up to the operating position shown in FIG. 9. Accordingly, the lock release lever 115 which is pressed by the cam surface 110 of the worm wheel 104 rotates clockwise from the lock allowable position shown in FIG. 8 to the lock release position shown in FIG. 9. Thereupon, the press portion 117 of the lock release lever 115 presses the pressed portion 49 of the pawl 45 toward the left-hand side, so that the pawl 45 rotates to the non-engaging position against the biasing force of the torsion coil spring 65. As a result, the hook 35 rotates toward the unlocked position by the rotational biasing force of the torsion coil spring 64, and accordingly, rotating the back door 12 toward the fully-open position causes the hook 35 to rotate to the unlocked position, so that the striker 15 moves out of the lock groove 37 (and the striker entry grooves 53 and 71) (lock is released).

Subsequently, when a detector not shown in the drawings detects that the hook 35 has rotated to the unlocked position, the motor 97 stops rotating due to the power supplied to the motor 97 from the above-mentioned power source being automatically shut off. Thereupon, the rotational biasing force of the torsion coil spring 65 causes the pawl 45 to rotate clockwise to the engaging position shown in FIG. 6, while the biasing force of the torsion coil spring 125 causes the lock release lever 115 to rotate to the lock allowable position shown in FIG. 6. In addition, the worm 99 rotates in reverse to the initial position due to the worm wheel 104 rotating back to the initial position by the biasing force of the coil spring 100.

Figure 10:
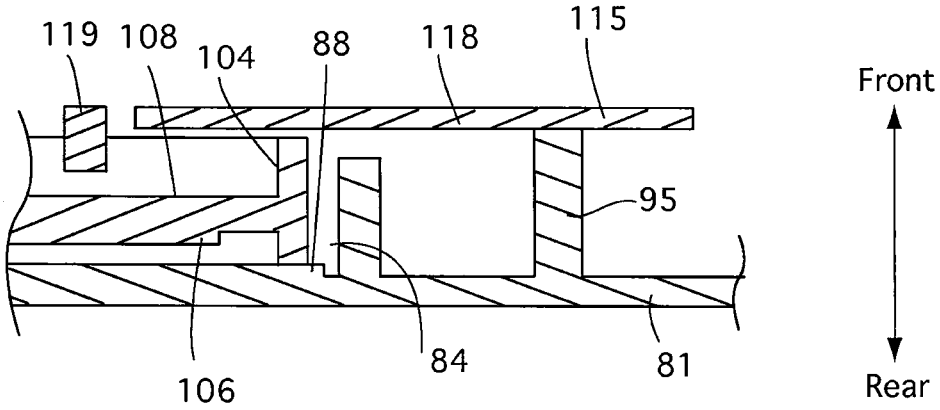
FIG. 10 is a sectional view taken along the line X-X shown in FIG. 6.

In the present embodiment of the lock device 20, during rotation of the lock release lever 115 about the rotational support shaft 92, two points of the lock release lever 115 (the rotational support hole 116 and the end of the straddle portion 118) are supported by two points (the rotational support shaft 92 and the holding elongated protrusion 95) of the rear case 81 in a double-end supporting manner, and accordingly, the cam follower 119 is spaced forward from the base (rear) of the rearward recess 108 at all times as shown in FIG. 10. Therefore, during rotation of the lock release lever 115, the cam follower 119 does not come in contact with the base (front) of the rearward recess 108 in a direction parallel to the rotational center shaft 102, and the straddle portion 118 does not come in contact with the front end surface of the worm wheel 104. Consequently, a smooth rotation of the lock release lever 115 is ensured, so that the lock release operation of the lock device 20 is performed smoothly at all times.

Moreover, since the straddle portion 118 of the lock release lever 115 is supported in a double-end supporting manner by the rotational support shaft 92 and the holding elongated protrusion 95, the state of supporting the lock release lever is stable. Therefore, the lock release lever 115 rotates smoothly even if an unexpected external force is exerted on the lock release lever 115.

In addition, since upper and lower surfaces of the pawl 45 are in contact with the curved elongated protrusion 32 of the support case 26 and the lower surface of the retaining projection 68, respectively, the pawl 45 does not rattle during the rotational operation thereof. Additionally, since the lower surface of the hook 35 is also in contact with the curved elongated protrusion 32 (the upper surface of the hook 35 is in contact with the lower surface of the spring support member 52), the hook 35 does not rattle during the rotational operation thereof. Moreover, the undersurfaces of the hook 35 and the pawl 45 are in contact with the curved elongated protrusion 32 at all times in any of the states shown in FIGS. 6 through 9.

In the case where the motor 97 does not rotate due to a malfunction or the like even if the lock release switch S is pressed, a rod member (not shown) such as a screwdriver is inserted into the clearance between the base of the back door 12 and the back opening 11 to be inserted into a hole (not shown) formed in the base of the back door 12. Thereupon, the end of the rod member passes through a clearance A (see FIG. 4) formed between the rear casing 81 and the front cover 122 and presses the pressed projection 120, which causes the lock release lever 115 to rotate to the lock release position. Accordingly, even in this sort of emergency, it is possible to release the lock of the lock device 20.

Although the lock device 20 is provided on the backdoor 12 while the striker 15 is provided on the vehicle body in the above illustrated embodiment, it is acceptable to provide the lock device 20 on the vehicle body and provide the striker 15 on the back door 12, respectively.

In addition, although the present embodiment is directed to the back door 12 of a vehicle to which the present invention has been applied, it is of course possible that the present invention be applied to other vehicle doors (e.g., a side door).

Additionally, the holding elongated protrusion 95 can be brought into sliding contact with the front of the rear casing 81 by forming the holding elongated protrusion 95 on a rear surface of the straddle portion 118 (surface thereof which faces the rear casing 81) rather than on the rear casing 81. Additionally, the shape of the holding elongated protrusion 95 can be made different from the shape shown in the drawings even when the holding elongated protrusion 95 is formed on either of the lock release lever 115 and the rear casing 81.

INDUSTRIAL APPLICABILITY

According to the lock device of the present invention, the present invention has industrial applicability due to a smooth rotation of the lock release lever being ensured.

REFERENCE SIGNS LIST

10 Automobile (Vehicle)
11 Back Opening
12 Back Door (Door)
15 Striker
20 Lock Device
25 Lock Unit
26 Support Case
27 Accommodation Recess
28 Fixing Lug
29 Striker Entry Groove
31 Positioning Recess
32 Curved Elongated Protrusion
34 Hook Support Shaft
35 Hook
36 Circular Support Hole
37 Lock Groove
38 Lock Projection
39 Half-Lock Projection
40 Spring Hook Projection
42 Pawl Support Shaft
45 Pawl
46 Circular Support Hole
47 Unlocking Engaging Surface
48 Engaging Projection
49 Pressed Portion
50 Pressed Projection
52 Spring Support Member
53 Striker Entry Groove
54 Engagement Holding Groove
55 56 Spring Accommodation Space
57 58 Rotational Support Cylinder
60 61 Circular-Arc Groove
62 Insertion Hole
63 Notch
64 Torsion Coil Spring
65 Torsion Coil Spring
67 Retaining Member
68 Retaining Projection
70 Top Cover
71 Striker Insertion Groove
72 Oblique Connecting Lug
73 Engaging Lug
74 Support Hole
80 Actuator Unit
81 Rear Case (Support Member)
82 Accommodation Recess
83 Motor Accommodation Space
84 Worm-Wheel Accommodation Space
85 Partition Wall
86 Shaft Support Recess
88 Support Seat
89 Rotational Support Cylinder
90 Spring-Support Elongated Protrusion
92 Rotational Support Shaft
93 Female Screw Hole
94 Support Recess
95 Holding Elongated Protrusion (Holding Portion)
97 Motor (Actuator)
98 Output Shaft
99 Worm
100 Coil Spring
102 Rotational Center Shaft
104 Worm Wheel (Cam Member)
105 Support Through-Hole
106 Circular-Arc-Shaped Projection
108 Rearward Recess
109 Cam Portion
110 Cam Surface
111 First Stopper
112 Second Stopper
115 Lock Release Lever
116 Rotational Support Hole (Rotational Center Portion)
117 Press Portion
118 Straddle Portion
119 Cam Follower
120 Pressed Projection (Pressed Portion)
122 Front Cover
124 Set Screw
125 Torsion Coil Spring
S Lock Release Switch

The invention claimed is:

1. A lock device for vehicle which is installed to one of a vehicle body and a door capable of being opened and closed with respect to said vehicle body, said lock device comprising:

a hook rotatable between a locked position at which said hook is engaged with a striker that is provided on the other of said vehicle body and said door to hold a closed state of said door, and an unlocked position at which said hook is disengaged from said striker, said hook being biased to rotate toward said unlocked position;

a pawl rotatable between an engaging position at which said pawl is engaged with said hook to hold said hook in said locked position and a non-engaging position at which said pawl is not engaged with said hook, said pawl being biased to rotate toward said engaging position;

a cam member rotatable relative to a support member about a rotational center shaft and having a cam surface;

an actuator which produces a driving force for rotating said cam member; and a lock release lever which includes a rotational center portion supported to be rotatable relative to said support member, and a cam follower which is positioned between said rotational center portion and an end of said lock release lever and comes in contact with said cam surface, wherein, by receiving a force from said cam surface via said cam follower, said lock release lever rotates between a lock allowable position at which said pawl is allowed to be positioned in said engaging position and a lock release position at which said pawl is made to rotate to said non-engaging position, wherein said lock release lever extends over said cam member, and wherein a holding portion is formed on one of said end of said lock release lever and said support member, and is in slidable contact with the other, and wherein said holding portion is positioned on a hypothetical line connecting said rotational center portion of said lock release lever and said cam follower.

2. The lock device for vehicle according to claim 1, wherein a portion of said lock release lever which ranges from said rotational center portion to said end is substantially straight in shape.

3. The lock device for vehicle according to claim 1, wherein a pressed portion is formed at said end of said lock release lever to enable a locked state to be released by pressing said pressed portion.

4. The lock device for vehicle according to claim 1, wherein said lock release lever is held in a state where said cam follower is spaced from said cam member in a direction parallel to a rotational support shaft of said lock release lever.

5. The lock device for vehicle according to claim 1, wherein said holding portion constitutes a part of a member containing said cam member.

6. The lock device for vehicle according to claim 1, wherein said cam follower constantly comes into contact with said cam surface of said cam member when said cam member is driven by a motor.

7. The lock device for vehicle according to claim 1, wherein a worm that is engaged with said cam member is provided between said cam member and said rotational center portion of said lock release lever.

8. The lock device for vehicle according to claim 1, wherein a radial distance from the rotational center of said cam member to said cam surface varies depending on the circumferential position of said cam surface.

9. The lock device for vehicle according to claim 1, wherein in said support member, a stopper is provided in order to restrict the rotational range of said cam follower.

* * * * *